US012053684B2

(12) United States Patent
Auld

(10) Patent No.: US 12,053,684 B2
(45) Date of Patent: Aug. 6, 2024

(54) SPORT SWING TRAINER WITH STRAP AND ELASTIC BAND

(71) Applicant: Athletic Forge LLC, Riverside, CA (US)

(72) Inventor: Brenn Auld, Riverside, CA (US)

(73) Assignee: Athletic Forge LLC

( * ) Notice: Subject to any disclaimer, the term of this patent is extended or adjusted under 35 U.S.C. 154(b) by 209 days.

(21) Appl. No.: 17/581,463

(22) Filed: Jan. 21, 2022

(65) Prior Publication Data

US 2022/0233940 A1 Jul. 28, 2022

Related U.S. Application Data

(60) Provisional application No. 63/140,425, filed on Jan. 22, 2021.

(51) Int. Cl.

| | |
|---|---|
| ***A63B 69/38*** | (2006.01) |
| ***A63B 71/06*** | (2006.01) |
| *A63B 21/00* | (2006.01) |
| *A63B 21/04* | (2006.01) |
| *A63B 21/055* | (2006.01) |

(52) U.S. Cl.

CPC ..... *A63B 69/38* (2013.01); *A63B 71/0622* (2013.01); *A63B 21/0442* (2013.01); *A63B 21/0552* (2013.01); *A63B 21/4035* (2015.10); *A63B 2071/0625* (2013.01); *A63B 2071/068* (2013.01); *A63B 2220/30* (2013.01); *A63B 2220/833* (2013.01); *A63B 2230/75* (2013.01)

(58) Field of Classification Search

CPC ..... A63B 69/38; A63B 69/36; A63B 69/0002; A63B 2069/0008; A63B 71/0622; A63B 71/0625; A63B 21/0442; A63B 21/0552; A63B 2220/30; A63B 2220/833; A63B 2071/0625; A63B 21/4035

See application file for complete search history.

(56) References Cited

U.S. PATENT DOCUMENTS

| | | | | | |
|---|---|---|---|---|---|
| 2,593,940 | A * | 4/1952 | Meter | A01K 27/005 | 267/74 |
| 3,618,942 | A * | 11/1971 | Bates | A63B 21/04 | 482/129 |
| 4,544,155 | A * | 10/1985 | Wallenbrock | A63B 21/4043 | 482/129 |
| 4,600,190 | A * | 7/1986 | Berokoff | A63B 69/0057 | 482/129 |
| 6,142,889 | A * | 11/2000 | Schaubach | A63B 69/0079 | 473/424 |

(Continued)

FOREIGN PATENT DOCUMENTS

| | | | | |
|---|---|---|---|---|
| CH | 706812 A2 * | 2/2014 | | A63B 21/0442 |
| DE | 4016588 A1 * | 11/1991 | | A63B 69/38 |
| WO | WO-0012181 A1 * | 3/2000 | | A63B 21/1663 |

*Primary Examiner* — Raleigh W Chiu
(74) *Attorney, Agent, or Firm* — JT IP Law PC

(57) ABSTRACT

A trainer for improving an athletic swing includes an elastic band having an anchor end and a handle end, and configured to expand and contract. The trainer further includes a handle coupled to the handle end of the elastic band and configured to be gripped by a user. The trainer further includes a strap coupled to the anchor end of the elastic band and configured to be sandwiched between two objects to anchor the anchor end of the elastic band to at least one of the two objects.

19 Claims, 5 Drawing Sheets

(56) References Cited

U.S. PATENT DOCUMENTS

| | | | | |
|---|---|---|---|---|
| 8,602,922 | B2 * | 12/2013 | Schwenger | A63B 60/42 473/549 |
| D741,433 | S * | 10/2015 | Auld | D21/799.1 |
| D996,552 | S * | 8/2023 | Auld | D21/799.1 |
| 2007/0010344 | A1 * | 1/2007 | Mackay | A63B 15/00 473/257 |
| 2009/0215555 | A1 * | 8/2009 | Seiter | A63B 69/3623 473/422 |
| 2011/0092347 | A1 * | 4/2011 | Kassel | A63B 21/0552 482/121 |
| 2012/0202611 | A1 * | 8/2012 | Warren | A63B 69/3623 473/422 |
| 2013/0274074 | A1 * | 10/2013 | Ghandour | A63B 15/00 482/93 |
| 2013/0303297 | A1 * | 11/2013 | Mackie | A63B 49/08 473/457 |
| 2014/0378250 | A1 * | 12/2014 | Shocklee, Jr. | A63B 60/08 473/457 |
| 2015/0057112 | A1 * | 2/2015 | Sak | A63B 24/0003 473/461 |
| 2016/0129330 | A1 * | 5/2016 | Rodriguez | A63B 69/0002 473/564 |
| 2016/0144260 | A1 * | 5/2016 | Cohen | A63B 69/38 473/461 |
| 2018/0169494 | A1 * | 6/2018 | Williams | A63B 69/0057 |
| 2018/0256952 | A1 * | 9/2018 | Mims | A63B 69/38 |
| 2019/0126117 | A1 * | 5/2019 | Franco | A63B 60/16 |
| 2020/0282281 | A1 * | 9/2020 | Thomas | A63B 21/0557 |
| 2020/0298046 | A1 * | 9/2020 | Davis | A63B 21/00069 |
| 2022/0233940 | A1 * | 7/2022 | Auld | A63B 15/00 |

* cited by examiner

SPORT SWING TRAINER WITH STRAP AND ELASTIC BAND

BACKGROUND

Field

The present disclosure is directed to athletic equipment and, more particularly, to trainers used to improve an athletic swing.

Description of the Related Art

Athletes at all skill levels train formally and informally to improve their endurance and abilities. This training can range from hiring a coach or personal trainer to performing certain exercises in their residence. Many athletes prefer the latter because it is less expensive and easier to train at their residence, and athletes that hire personal trainers also train on their own from time to time to supplement the coached training. Some exercises can be performed in one's residence without equipment, but specialized equipment may be necessary for certain training exercises. Some sports require swinging of an object (e.g., a tennis racket, a golf club, etc.). As with other sports, athletes may train sport-specific motions (e.g., swinging an object) in order to increase strength and speed of that sport-specific motion. Presently, no equipment for practicing a swinging motion exists in the market.

Thus, there is a need in the art for a sport swing trainer.

SUMMARY

Described herein is a trainer for improving an athletic swing. The trainer includes an elastic band having an anchor end and a handle end, and configured to expand and contract. The trainer further includes a handle coupled to the handle end of the elastic band and configured to be gripped by a user. The trainer further includes a strap coupled to the anchor end of the elastic band and configured to be sandwiched between two objects to anchor the anchor end of the elastic band to at least one of the two objects.

In any of the foregoing embodiments, the handle has 8 sides and resembles a tennis racket handle.

Any of the foregoing embodiments may further include a strap stopper configured to be located within the elastic band towards the anchor end, wherein the strap is coupled to the elastic band by coupling a first end of the strap to another portion of the strap with the strap stopper and a portion of the elastic band enclosed within the strap to resist separation of the strap from the anchor end of the elastic band.

Any of the foregoing embodiments may further include a clip coupled to the strap and configured to clip to an anchor point to removably couple the anchor end to the anchor point.

In any of the foregoing embodiments, the clip includes a slot configured to receive the strap such that the strap is coupled to the clip by extending a second end of the strap through the slot and coupling the second end of the strap to another location on the strap.

Any of the foregoing embodiments may further include a handle stopper configured to be located within the elastic band towards the handle end, wherein: the handle includes a first portion and a second portion configured to be coupled to the first portion; the first portion and the second portion each define an internal wall extending towards a center of the handle; and the handle is coupled to the elastic band by placing the handle stopper and the handle end of the elastic band between the internal wall of the first portion and the second portion and coupling the first portion to the second portion.

Any of the foregoing embodiments may further include a first weight, wherein at least one of the first portion or the second portion includes internal bridges such that the first weight is enclosed within the handle and retained in place relative to the handle by at least two of the internal bridges when the first portion is coupled to the second portion.

In any of the foregoing embodiments, a total weight of the handle can be adjusted by replacing the first weight with a second weight having a different mass than the first weight.

Any of the foregoing embodiments may further include: a sensor located in the handle and configured to detect data corresponding to use of the trainer; an output device located in or on the handle and configured to output data; and a controller coupled to the sensor, located in the handle, and configured to determine information corresponding to the use of the trainer based on the data detected by the sensor and to control the output device to output the information.

In any of the foregoing embodiments, the information determined by the controller includes at least one of: a duration of use of the trainer; a speed of a swing of the handle by the user; a type of swing of the handle by the user; an angle of contact between an imaginary head coupled to the handle and an imaginary ball; an amount of calories burned during a training session with the trainer; or a remaining life of the elastic band.

Also disclosed is a trainer for improving an athletic swing. The trainer includes an elastic band having an anchor end and a handle end, and configured to expand and contract. The trainer further includes a handle coupled to the handle end of the elastic band and configured to be gripped by a user, the handle having 8 sides and resembling a tennis racket handle. The trainer further includes a strap coupled to the anchor end of the elastic band and configured to be sandwiched between two objects to anchor the anchor end of the elastic band to at least one of the two objects. The trainer further includes a strap stopper configured to be located within the elastic band towards the anchor end, wherein the strap is coupled to the elastic band by coupling a first end of the strap to another portion of the strap with the strap stopper and a portion of the elastic band enclosed within the strap to resist separation of the strap from the anchor end of the elastic band.

Any of the foregoing embodiments may further include a clip coupled to the strap and configured to clip to an anchor point to removably couple the anchor end to the anchor point.

In any of the foregoing embodiments, the clip includes a slot configured to receive the strap such that the strap is coupled to the clip by extending a second end of the strap through the slot and coupling the second end of the strap to another location on the strap.

Any of the foregoing embodiments may further include a handle stopper configured to be located within the elastic band towards the handle end, wherein: the handle includes a first portion and a second portion configured to be coupled to the first portion; the first portion and the second portion each define an internal wall extending towards a center of the handle; and the handle is coupled to the elastic band by placing the handle stopper and the handle end of the elastic band between the internal wall of the first portion and the second portion and coupling the first portion to the second portion.

Any of the foregoing embodiments may further include a first weight, wherein at least one of the first portion or the second portion includes internal bridges such that the first weight is enclosed within the handle and retained in place relative to the handle by at least two of the internal bridges when the first portion is coupled to the second portion.

In any of the foregoing embodiments, a total weight of the handle can be adjusted by replacing the first weight with a second weight having a different mass than the first weight.

Any of the foregoing embodiments may further include: a sensor located in the handle and configured to detect data corresponding to use of the trainer; an output device located in or on the handle and configured to output data; and a controller coupled to the sensor, located in the handle, and configured to determine information corresponding to the use of the trainer based on the data detected by the sensor and to control the output device to output the information.

In any of the foregoing embodiments, the information determined by the controller includes at least one of: a duration of use of the trainer; a speed of a swing of the handle by the user; a type of swing of the handle by the user; an angle of contact between an imaginary head coupled to the handle and an imaginary ball; an amount of calories burned during a training session with the trainer; or a remaining life of the elastic band.

Also disclosed is a trainer for improving an athletic swing. The trainer includes an elastic band having an anchor end and a handle end, and configured to expand and contract; a handle coupled to the handle end of the elastic band and configured to be gripped by a user; a strap coupled to the anchor end of the elastic band and configured to be sandwiched between two objects to anchor the anchor end of the elastic band to at least one of the two objects; and a clip coupled to the strap and configured to clip to an anchor point to removably couple the anchor end to the anchor point.

In any of the foregoing embodiments, the handle has 8 sides and resembles a tennis racket handle.

DETAILED DESCRIPTION

Figures 1A, 1B, 1C, 1D, 1E, 1F:
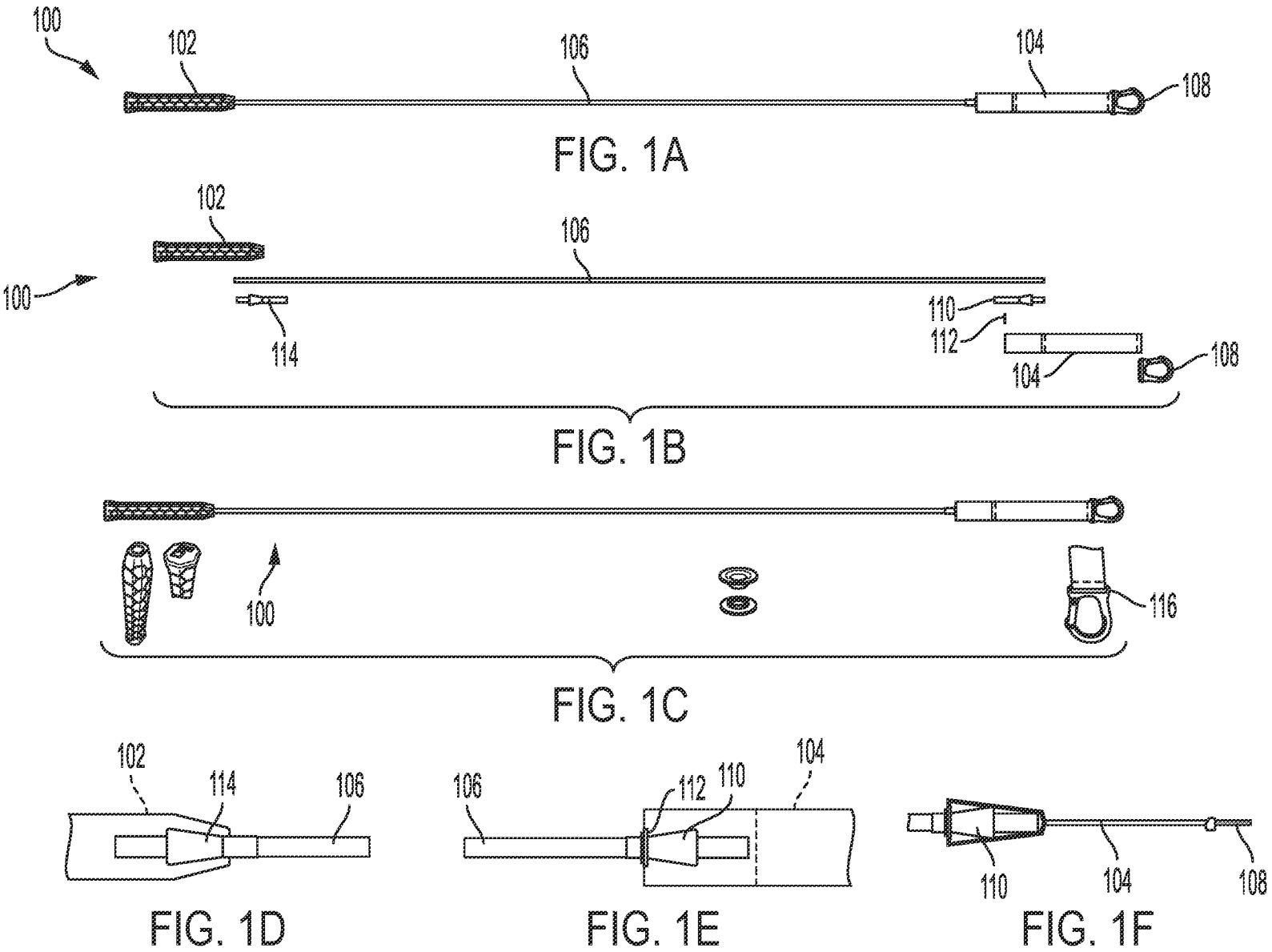
FIG. 1A illustrates an assembled trainer in accordance with embodiments of the present disclosure.
FIG. 1B illustrates separate components of the trainer of FIG. 1A in accordance with embodiments of the present disclosure.
FIG. 1C illustrates additional features of the trainer of FIG. 1A in accordance with embodiments of the present disclosure.
FIG. 1D is an enlarged view of a portion of a handle end of the trainer of FIG. 1A in accordance with embodiments of the present disclosure.
FIG. 1E is an enlarged view of a portion of a strap side of the trainer of FIG. 1A in accordance with embodiments of the present disclosure.
FIG. 1F is an enlarged view of a portion of a strap side of the trainer of FIG. 1A in accordance with embodiments of the present disclosure.

The present disclosure describes a sport swing trainer. The trainer is used as a training tool for strengthening muscles and endurance and improving speed and muscle memory related to a sport-related swing (e.g., a tennis swing, a golf swing, or the like) and improving the quality of the swing. The trainer provides benefits and advantages such as including a handle that is designed to replicate a handle of sporting goods (e.g., it may have 8 sides and be sized to replicate a handle of a tennis racket). The trainer is designed for use anywhere with an anchor point or a door, which advantageously allows users to train and improve their swing from any location, even while traveling.

The trainer includes both a clip (e.g., a carabiner) usable to anchor the trainer to an anchor point as well as a strap that can be sandwiched between a door and a door jamb to anchor the trainer to the door/door jamb. The handle of the trainer may include two portions that are removably coupled together, and the trainer may come with multiple weights that can each be coupled or installed inside of the handle to adjust a total weight of the handle. The trainer includes an elastic band that extends from the handle to the clip/strap and is removably coupled to the handle and the clip/strap to facilitate replacement of the elastic band when it becomes worn out.

Referring generally to FIGS. 1A-5, an exemplary sport trainer 100 is shown. The trainer 100 includes a handle 102, a strap 104, an elastic band 106, and a clip 108. The handle 102 may resemble a handle of a piece of sporting equipment. For example, the handle 102 may have eight sides and be formed to have a similar shape as a handle of a tennis racket. As another example, the handle 102 may be formed to resemble a handle of a golf club. The handle 102 may be formed by first forming a plastic undermold and adding a softer overmold to the plastic undermold to improve the ability to grip the handle 102.

The strap 104 may be formed from a fabric material such as a nylon webbing. In some embodiments, the strap 104 may include any other fabric or material (e.g., polybutylene terephthalate (PBT)), however, it is desirable for the strap 104 to be formed from a relatively strong material to increase durability of the trainer 100 as pressure will be applied to the strap 104 during use. The strap 104 may be designed to be placed between a door and a door jamb to anchor the trainer 100 to the door/door jamb.

The elastic band 106 may be formed from any elastic material (e.g., any elastomer such as natural rubber, styrene-butadiene block copolymers, polyisoprene, polybutadiene, ethylene propylene rubber, ethylene propylene diene rubber, silicone elastomers, fluoroelastomers, polyurethane elastomers, nitrile rubbers, or the like) and may have a handle end coupled to the handle 102 and an anchor end coupled to the strap 104. In some embodiments, the elastic band 106 may have a tubular shape which, as discussed below, facilitates coupling of the elastic band 106 to the handle 102 and the strap 104. However, the elastic band may have any shape or cross section without departing from the scope of the present disclosure.

The clip 108 may be coupled to the strap 104 and may include any clip usable to anchor the clip 108 to an object. In that regard, the trainer 100 may be anchored in place either via the clip 108 or via the strap 104. In some embodiments, the clip 108 may include a carabiner or a carabiner-like clip. In some embodiments, the clip 108 may include any other type of clip. In some embodiments, the clip 108 may include a locking mechanism to lock the clip 108 to whatever anchor point it is coupled to in order to reduce the likelihood of the clip 108 becoming uncoupled from the anchor point. The clip 108 may be formed from a relatively hard material or relatively high-strength material (e.g., relatively high compressive strength or relatively high yield strength) such as anodized steel, carbon steel, or any metal or metal alloys.

The handle 102 may be formed from any material, and may be designed to resemble a handle of sporting equipment (e.g., a handle of a tennis racket or golf club). For example, the handle 102 may be formed from a plastic or other polymer, a metal, or the like. As described below, the handle 102 may include an overmolding to provide a better grip.

In use, the trainer 100 may be anchored in place by either the clip 108 or the strap 104. For example, the clip 108 may be attached to an object (such as a weighted bench, an anchor installed on a floor or wall of a building, or the like. As another example, the strap 104 may be positioned between a door and a door jamb, and the door may be closed such that the strap 104 is anchored between the door and the door jamb. A user may then grip the handle 102 and practice a sport swing (e.g., a swing of a tennis racket). The elastic band 106 may expand as the user moves through the swinging motion, providing resistance against the swing. This resistance applied by the elastic band 106 helps strengthen muscles associated with the swing and improves endurance of the user. After the user has completed the swing, the elastic band 106 contracts to its original shape so the user can continue to practice the swing while strengthening her muscles and building her endurance.

As discussed above, the elastic band 106 may include a tube shape to facilitate coupling the elastic band 106 to the handle 102 and the strap 104. In particular and referring to FIGS. 1C-1F, the trainer 100 may include a strap stopper 110 and a handle stopper 114. The strap stopper 110 may be positioned within the tube of the elastic band 106. The strap 104 may have an opening defined therein, and a grommet 112 may be located within the opening. In order to couple the elastic band 106 to the strap 104, the tube of the elastic band 106 may be extended through the grommet 112 and the strap stopper 110 may be positioned within the tube. The strap 104 may then be doubled over and fastened to itself (e.g., by sewing the strap or by a removable interface such as hook-and-loop fasteners) such that an interface between the strap stopper and the grommet reduces the likelihood of separation of the elastic band 106 from the strap 104.

Figure 2:
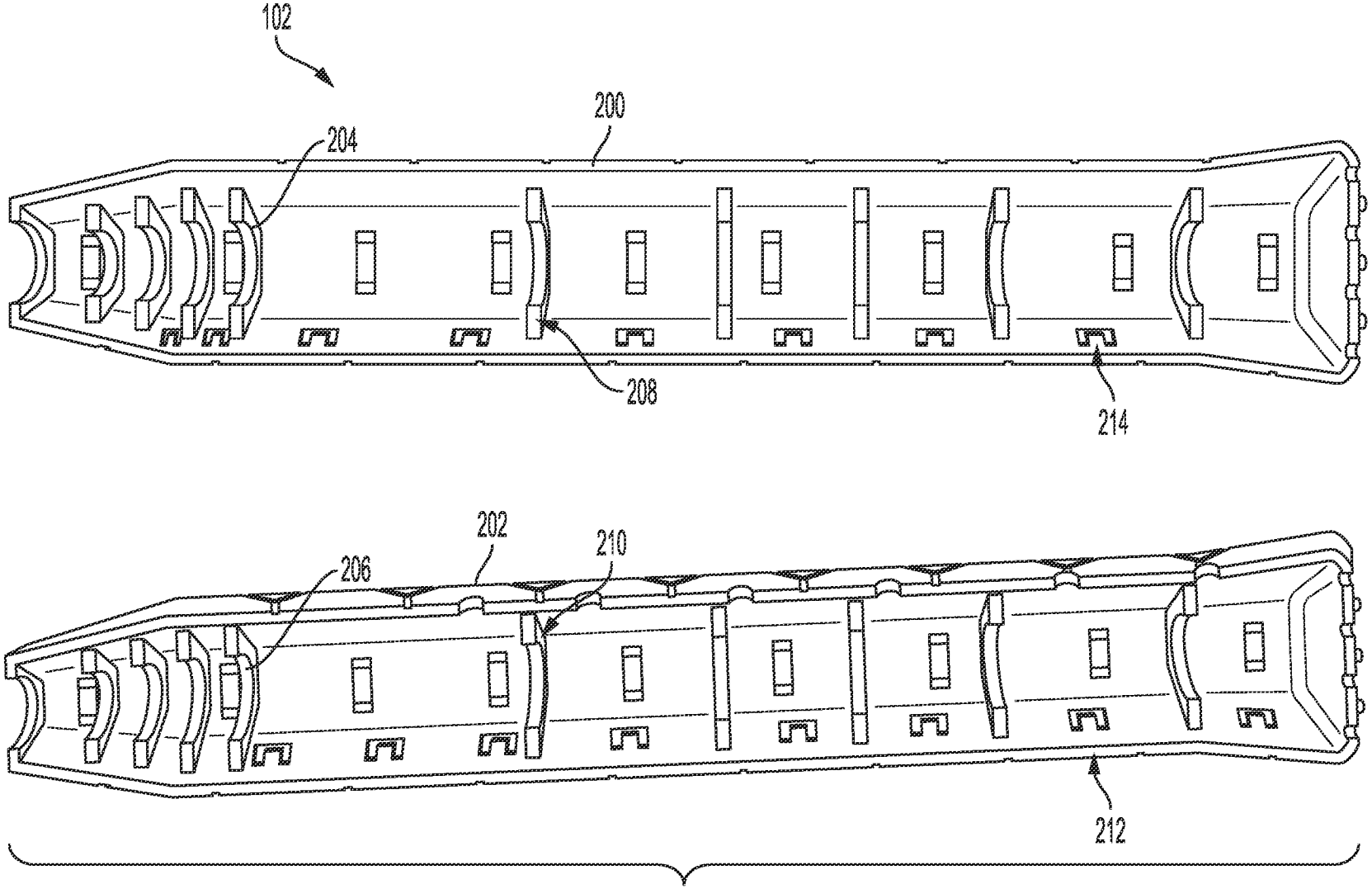
FIG. 2 illustrates a disassembled handle of the trainer of FIG. 1A in accordance with embodiments of the present disclosure.

In order to couple the elastic band 106 to the handle 102, the handle stopper 114 may be positioned within the tube of the elastic band 106. Referring to FIGS. 1C, 1D, and 2, the handle 102 may include a first portion 200 and a second portion 202. Each of the first portion 200 and the second portion 202 may define an internal wall 204, 206 extending towards a center of the handle 102. In some embodiments, the handle 102 may further define internal bridges 208, 210 that resemble the walls 204, 206 (or may have different shapes from the walls 204, 206) The tube of the elastic band 106 with the handle stopper 114 located therein may be positioned between the internal walls 204, 206 and the first portion 200 may be coupled to the second portion 202 to assemble the handle with the handle stopper 114 and elastic band 106. In some embodiments, the tube of the elastic band 106 with the handle stopper 114 may be sandwiched between the internal wall 204 and the bridge 208, and between the internal wall 206 and the bridge 210 when the first portion 200 is coupled to the second portion 202. The interface between the handle stopper 114 and the internal walls 204, 206 resists separation of the elastic band 106 from the handle 102. That is, the internal walls 204, 206 resist movement of the handle stopper 114 (and thus the elastic band 106) along a longitudinal axis of the handle 102.

As suggested above, the first portion 200 of the handle 102 is designed to be coupled to the second portion 202 of the handle 102. For example, the first portion 200 may include male connectors 214 and the second portion 202 may include female connectors 212 designed to receive the male connectors 214. The interface between the male connectors 214 and the female connectors 212 resists separation of the first portion 200 from the second portion 202. This connection between the first portion 200 and the second portion 202 may be removable such that the first portion 200 may be disconnected from, and then reconnected to, the second portion 202. In this way, the elastic band 106 may be replaced by disconnecting it from the handle 102 and the strap 104. In some embodiments, the first portion 200 may be coupled to the second portion 202 in any known manner such as snap fit connectors, fasteners (e.g., screws, bolts, rivets, or the like), use of adhesive, or any other known manner.

Returning reference to FIGS. 1B and 1C, the strap 104 may also be coupled to the clip 108. In some embodiments, the clip 108 may define a slot 116. A portion of the strap 104 may extend through the slot 116 and the strap 104 may be fastened to itself (e.g., by sewing, rivets, fasteners, adhesive, or the like, or by removable means such as hook-and-loop fasteners, buttons, snap fit connectors, or the like) to couple the strap 104 to the clip 108.

Figure 3:
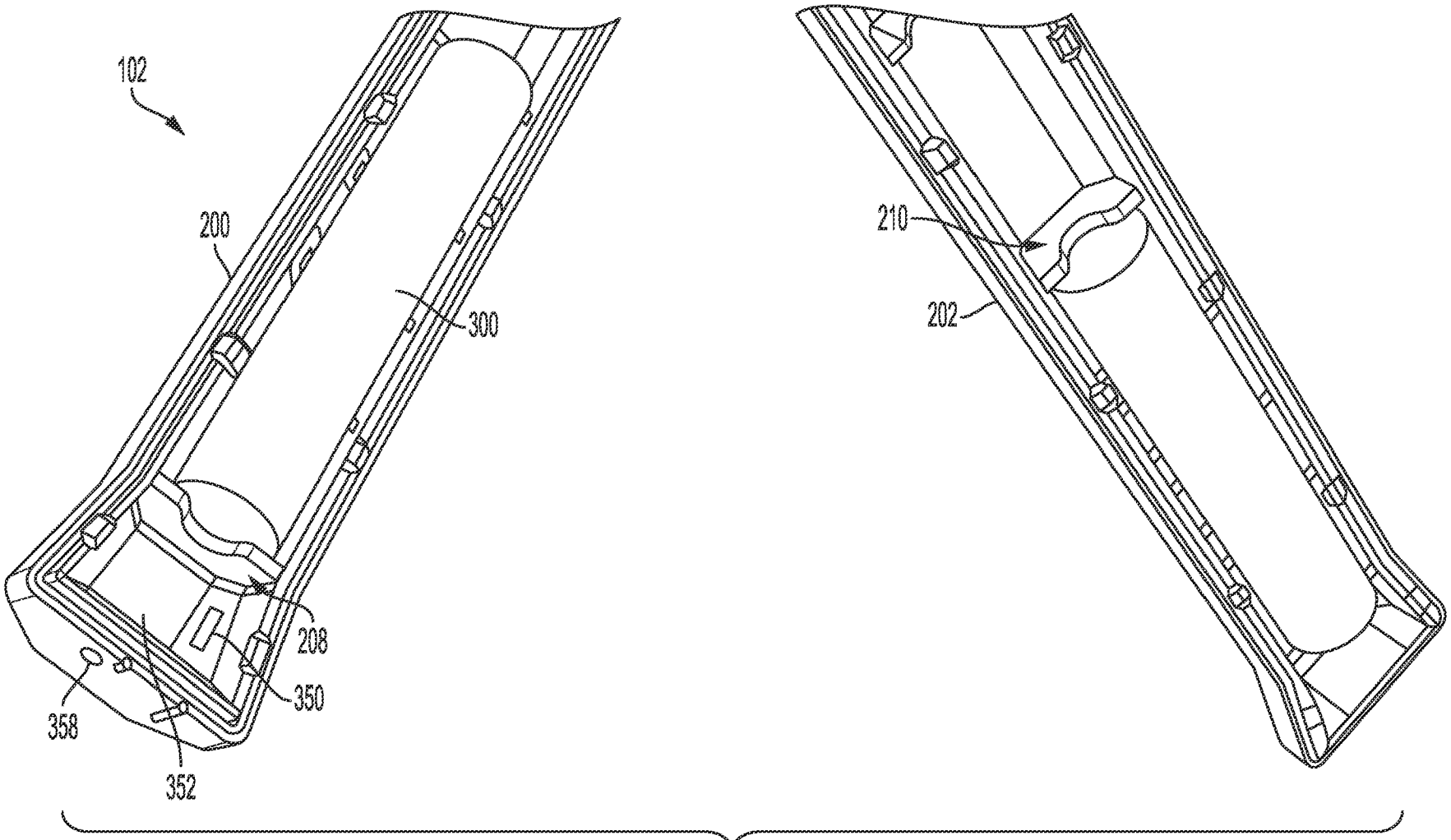
FIG. 3 illustrates the disassembled handle of FIG. 2 with added weights in accordance with embodiments of the present disclosure.

Referring to FIGS. 2 and 3 and in some embodiments, at least one of the first portion 200 or the second portion 202 of the handle 102 may also define or include internal bridges 208, 210. The internal bridges 208, 210 may extend towards a middle of the handle 102. In some embodiments, the bridges 208, 210 may be the same as, or different than, the internal walls 204, 206. The trainer 100 may further include a weight 300. The weight 300 may be located in the handle 102 and retained in place relative to the handle 102 by the internal bridges 208, 210. In this way, the weight of the handle 102 may be increased to give the handle 102 a more realistic feel. Furthermore, multiple weights may be provided that each have a different weight or mass such that the weight of the handle 102 may be adjusted by replacing the weight 300 with a different weight having a different mass. In that regard, a user of the trainer 100 may begin training with a lighter weight and work his or her way up to a heavier weight as they build strength in their swing. In some embodiments, the weight 300 may be optional based on the material of the handle 102. For example, if the handle 102 is formed from a plastic then inclusion of the weight 300 may be desirable to cause the handle 102 to feel more like a handle of the actual sporting good. However, if the handle 102 is made from metal then additional of the weight 300 may be unnecessary.

Figure 4:
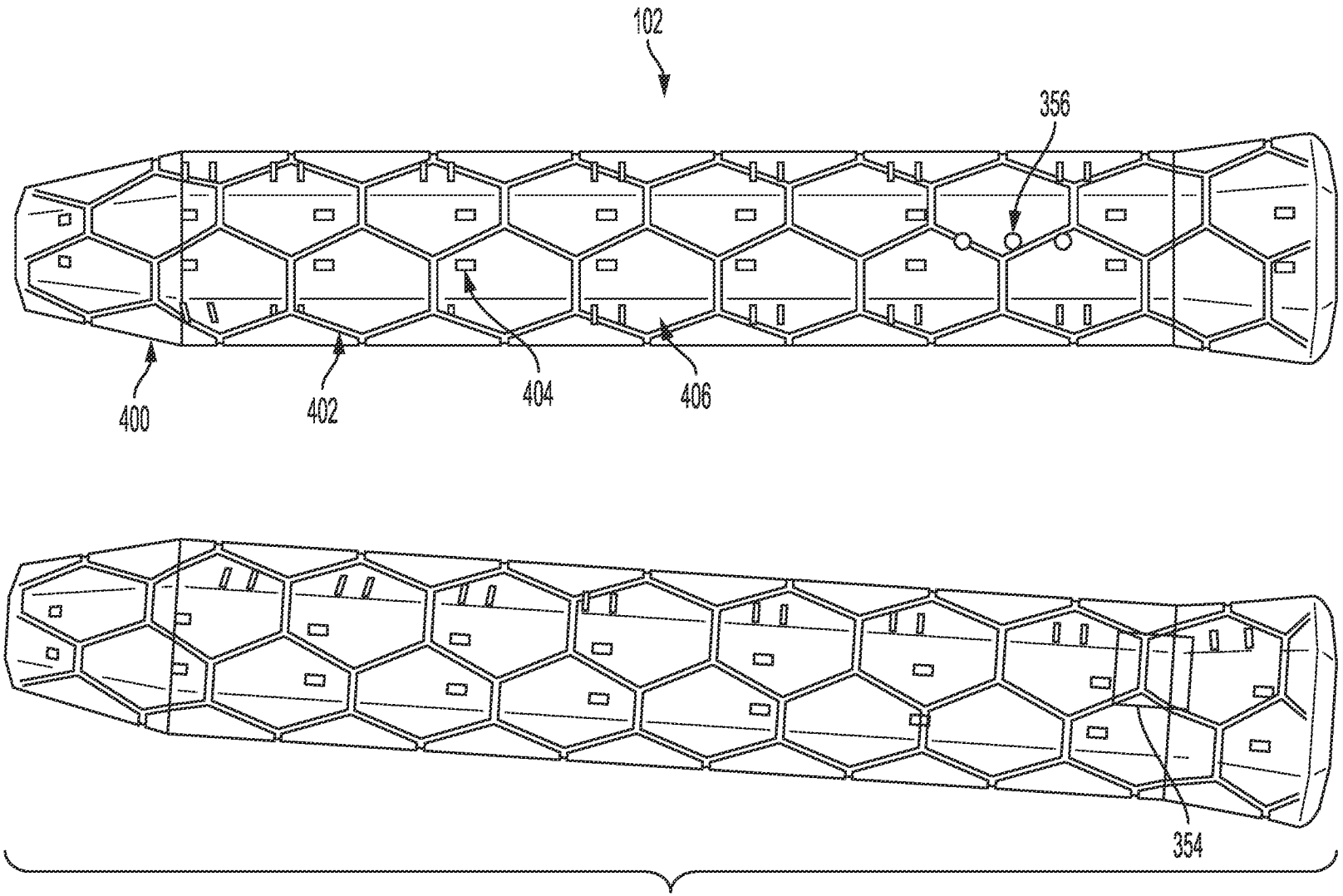
FIG. 4 illustrates the handle of FIG. 2 in an assembled state in accordance with embodiments of the present disclosure.
Figure 5:
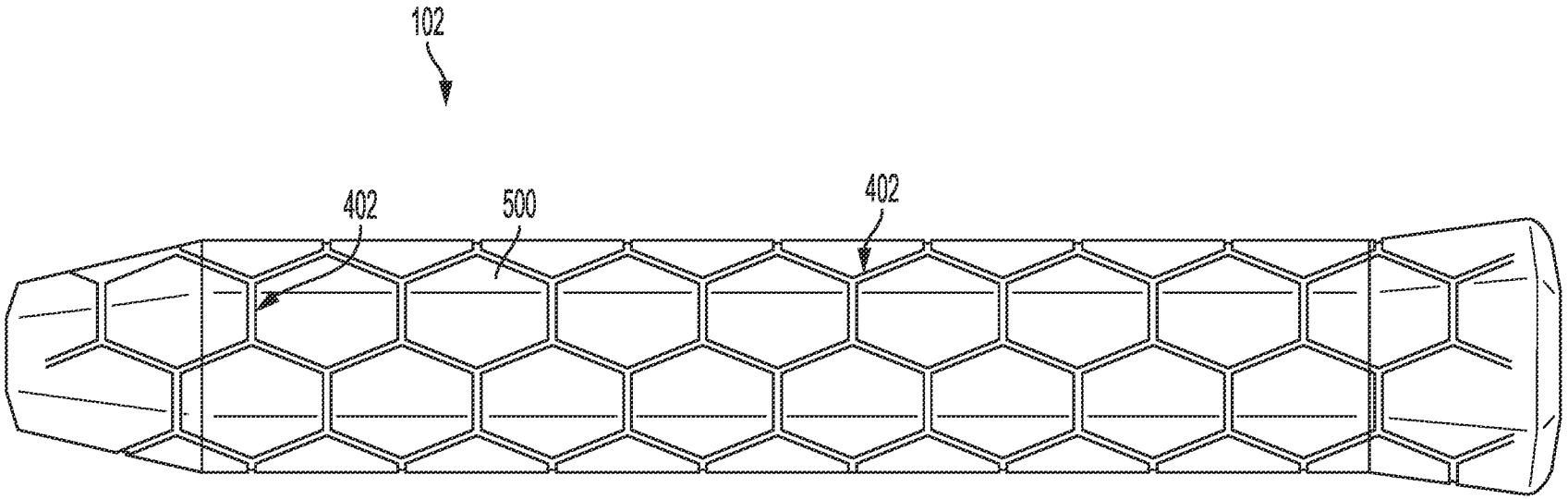
FIG. 5 illustrates an overmold material applied to the handle of FIG. 2 in accordance with embodiments of the present disclosure.

As mentioned above, the handle 102 may include an overmolding. In that regard and referring to FIGS. 4 and 5, the handle 102 may include a rigid undermold 400 (e.g., a plastic, metal, or other polymer material). The undermold 400 may define ridges 402 extending outward therefrom. In some embodiments, the ridges 402 may be designed with an octagonal pattern as shown in FIG. 4, but any other pattern or shape of ridges 402 is possible. The undermold 400 may also define openings 404 that extend therethrough (e.g., at least part of the way through a thickness of the undermold 400). An overmold material 500 (e.g., a thermoplastic elastomer, a poly foam, a graphite, or any other material) may then be applied to the undermold 400. The overmold material 500 may at least partially extend through the openings 404, thus increasing a quality of the coupling between the undermold 400 and the overmold material 500. In addition, the overmold material 500 may be located between the ridges 402 such that the ridges 402 extend at least partway through the overmold material 500, further resisting movement of the overmold material 500 relative to the undermold 400.

Referring to FIGS. 3 and 4 and in some embodiments, the trainer 100 may further include a sensor 350. The sensor 350 may include any sensor capable of detecting data corresponding to use of the trainer 100 and may be located in or on the handle 102. For example, the sensor may include an inertial measurement unit (IMU) which may include a gyroscope, an accelerometer, silicon micro-electro-mechanical systems (MEMS), or the like. The sensor 350 may detect data corresponding to use of the trainer such as a speed of a swing, a quantity of swings, a duration of use of the trainer 100, a type of swing, a direction of swing, an amount of power behind a swing, an angle of contact between an imaginary head coupled to the handle 102 and an imaginary ball, energy spent swinging the handle 102, information corresponding to a remaining life of the elastic band or other components, or any other information that may be useful for a user of the trainer 100.

The trainer 100 may further include a controller or processor 352. The controller or processor 352 may include any logic device such as a microprocessor, a set of discrete logic gates, a field programmable gate array (FPGA), an application specific processor (ASIC), or the like. In some embodiments, the controller or processor 352 may also include a non-transitory memory that stores instructions usable by the controller or processor 352 to perform functions. In some embodiments, the non-transitory memory may further store data as requested by the processor for later use. The controller or processor 352 may be coupled to the sensor 350 and may determine information corresponding to use of the trainer 100 based on the data detected by the sensor. For example, the controller or processor 352 may determine any one or more of a speed of a swing, a quantity of swings, a duration of use of the trainer 100, a type of swing, a direction of swing, an amount of power behind a swing, an angle of contact between an imaginary head coupled to the handle 102 and an imaginary ball, energy spent swinging the handle 102, information corresponding to a remaining life of the elastic band or other components, or any other information that may be useful for a user of the trainer 100.

The trainer 100 may further include an output device 354 such as a display, a touchscreen, a speaker, or the like. The output device may output information as directed by the controller or processor. For example, the controller or processor may control the output device to output any of the information corresponding to the use of the trainer 100.

The trainer 100 may also include an input device 356 such as a button, a switch, a microphone, a touchscreen, or the like. The input device may receive any user input such as a request to turn on the trainer 100, a request for the trainer 100 to output information, a request for certain types of information to be determined (e.g., a quantity of swings or a speed of swings) or the like.

In some embodiments, the trainer 100 may include a battery or other power source 358 (e.g., a plug to receive a power cable). The electronic components (e.g., sensor 350, controller or processor 352, output device 354, and input device 356) may be electrically coupled to the battery or other power source 358 such that the battery or other power source 358 provides electrical power to the electronic components.

In some embodiments and referring specifically to FIG. 3, in embodiments which include a battery, the battery may be used in place of the weight 300. The battery may be located in the handle 102 in a similar location as the weight 300 and may provide the same benefits as the weight 300.

Where used throughout the specification and the claims, "at least one of A or B" includes "A" only, "B" only, or "A and B." Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A trainer for improving an athletic swing, the trainer comprising:

an elastic band having an anchor end and a handle end, and configured to expand and contract;

a first weight;

a handle coupled to the handle end of the elastic band and configured to be gripped by a user, the handle including a first portion and a second portion configured to be coupled to the first portion, at least one of the first portion or the second portion defining internal bridges such that the first weight is enclosed within the handle and retained in place relative to the handle by at least two of the internal bridges when the first portion is coupled to the second portion; and a strap coupled to the anchor end of the elastic band and configured to be sandwiched between two objects to anchor the anchor end of the elastic band to at least one of the two objects.

2. The trainer of claim 1, wherein the handle has 8 sides and resembles a tennis racket handle.

3. The trainer of claim 1, further comprising a strap stopper configured to be located within the elastic band towards the anchor end, wherein the strap is coupled to the elastic band by coupling a first end of the strap to another portion of the strap with the strap stopper and a portion of the elastic band enclosed within the strap to resist separation of the strap from the anchor end of the elastic band.

4. The trainer of claim 3, further comprising a clip coupled to the strap and configured to clip to an anchor point to removably couple the anchor end to the anchor point.

5. The trainer of claim 4, wherein the clip includes a slot configured to receive the strap such that the strap is coupled to the clip by extending a second end of the strap through the slot and coupling the second end of the strap to another location on the strap.

6. The trainer of claim 1, further comprising a handle stopper configured to be located within the elastic band towards the handle end, wherein:

the first portion and the second portion each define an internal wall extending towards a center of the handle; and the handle is coupled to the elastic band by placing the handle stopper and the handle end of the elastic band between the internal wall of the first portion and the second portion and coupling the first portion to the second portion.

7. The trainer of claim 1, wherein a total weight of the handle can be adjusted by replacing the first weight with a second weight having a different mass than the first weight.

8. The trainer of claim 1, further comprising:

a sensor located in the handle and configured to detect data corresponding to use of the trainer;

an output device located in or on the handle and configured to output data; and a controller coupled to the sensor, located in the handle, and configured to determine information corresponding to the use of the trainer based on the data detected by the sensor and to control the output device to output the information.

9. The trainer of claim 8, wherein the information determined by the controller includes at least one of:

a duration of use of the trainer;

a speed of a swing of the handle by the user;

a type of swing of the handle by the user;

an angle of contact between an imaginary head coupled to the handle and an imaginary ball;

an amount of calories burned during a training session with the trainer; or a remaining life of the elastic band.

10. A trainer for improving an athletic swing, the trainer comprising:

an elastic band having an anchor end and a handle end, and configured to expand and contract;

a handle stopper configured to be located within the elastic band towards the handle end;

a handle coupled to the handle end of the elastic band and configured to be gripped by a user, the handle having 8 sides and resembling a tennis racket handle, the handle including a first portion and a second portion configured to be coupled to the first portion, each of the first portion and the second portion defining an internal wall extending towards a center of the handle such that the handle is removably coupled to the elastic band by placing the handle stopper and the handle end of the elastic band between the internal wall of the first portion and the second portion and coupling the first portion to the second portion, the removable coupling of the handle to the elastic band facilitating replacement of the elastic band; and a strap coupled to the anchor end of the elastic band and configured to be sandwiched between two objects to anchor the anchor end of the elastic band to at least one of the two objects.

11. The trainer of claim 10, further comprising a clip coupled to the strap and configured to clip to an anchor point to removably couple the anchor end to the anchor point.

12. The trainer of claim 11, wherein the clip includes a slot configured to receive the strap such that the strap is coupled to the clip by extending a second end of the strap through the slot and coupling the second end of the strap to another location on the strap.

13. The trainer of claim 10, further comprising a strap stopper configured to be located within the elastic band towards the anchor end, wherein the strap is coupled to the elastic band by coupling a first end of the strap to another portion of the strap with the strap stopper and a portion of the elastic band enclosed within the strap to resist separation of the strap from the anchor end of the elastic band.

14. The trainer of claim 10, further comprising a first weight, wherein at least one of the first portion or the second portion includes internal bridges such that the first weight is enclosed within the handle and retained in place relative to the handle by at least two of the internal bridges when the first portion is coupled to the second portion.

15. The trainer of claim 14, wherein a total weight of the handle can be adjusted by replacing the first weight with a second weight having a different mass than the first weight.

16. The trainer of claim 10, further comprising:

a sensor located in the handle and configured to detect data corresponding to use of the trainer;

an output device located in or on the handle and configured to output data; and a controller coupled to the sensor, located in the handle, and configured to determine information corresponding to the use of the trainer based on the data detected by the sensor and to control the output device to output the information.

17. The trainer of claim 16, wherein the information determined by the controller includes at least one of:

a duration of use of the trainer;

a speed of a swing of the handle by the user;

a type of swing of the handle by the user;

an angle of contact between an imaginary head coupled to the handle and an imaginary ball;

an amount of calories burned during a training session with the trainer; or a remaining life of the elastic band.

18. A trainer for improving an athletic swing, the trainer comprising:

an elastic band having an anchor end and a handle end, and configured to expand and contract;

a handle stopper configured to be located within the elastic band towards the handle end;

a handle coupled to the handle end of the elastic band and configured to be gripped by a user, the handle including a first portion and a second portion configured to be coupled to the first portion, each of the first portion and the second portion defining an internal wall extending towards a center of the handle such that the handle is removably coupled to the elastic band by placing the handle stopper and the handle end of the elastic band between the internal wall of the first portion and the second portion and coupling the first portion to the second portion, the removable coupling of the handle to the elastic band facilitating replacement of the elastic band;

a strap coupled to the anchor end of the elastic band and configured to be sandwiched between two objects to anchor the anchor end of the elastic band to at least one of the two objects.

19. The trainer of claim 18, further comprising a strap stopper configured to be located within the elastic band towards the anchor end, wherein the strap is coupled to the elastic band by coupling a first end of the strap to another portion of the strap with the strap stopper and a portion of the elastic band enclosed within the strap to resist separation of the strap from the anchor end of the elastic band.

* * * * *